US005634741A

United States Patent [19]

Tremblay et al.

[11] Patent Number: 5,634,741

[45] Date of Patent: Jun. 3, 1997

[54] FORM-DRAIN FILTER CLAMP

[76] Inventors: Richard L. Tremblay, 6 Hiawatha Dr.; Christopher G. Semenza, 101 Boyack Rd., both of Clifton Park, N.Y. 12065

[21] Appl. No.: 534,625

[22] Filed: Sep. 27, 1995

[51] Int. Cl.[6] ..... E02B 11/00

[52] U.S. Cl. ..... 405/43; 24/462; 52/169.14; 405/36; 405/45

[58] Field of Search ..... 405/43, 45, 36, 405/52; 24/563, 545, 67.9, 3.12, 462; 52/169.5, 169.14

[56] References Cited

U.S. PATENT DOCUMENTS

| | | | |
|---|---|---|---|
| 4,231,141 | 11/1980 | Derrick et al. | 24/462 |
| 4,539,734 | 9/1985 | Messerschmitt | 24/462 X |
| 4,562,634 | 1/1986 | Watts | 24/462 X |
| 4,799,299 | 1/1989 | Campbell | 24/462 |
| 4,858,285 | 8/1989 | Dala et al. | 24/545 X |
| 4,934,540 | 6/1990 | Novak | 24/563 X |
| 4,946,065 | 8/1990 | Goulter et al. | 24/545 X |
| 5,466,092 | 11/1995 | Semenza et al. | 405/45 |

*Primary Examiner*—Dennis L. Taylor

[57] ABSTRACT

A clamping mechanism for removably attaching a fabric to a foraminous element having generally a plank shape. A form-drain is a hollow, foraminous, plank-shaped conduit. The clamp of the invention is a semi-rigid strip of material such as polyvinylchloride. From the strip depend orthogonal projections which form, in a first model, a U-form of shallow definition; this is the "cap" model and is used to capture a fabric between it and the top surface of the form-drain. An alternate embodiment realizes the same strip with depending orthogonal studs (as projections). Projections of both embodiments include mechanisms to impede retrograde motion of the clamp once it is installed on the form-drain. In anticipation of changes to the form-drain, alternate models of the invention have been presented.

19 Claims, 3 Drawing Sheets

FORM-DRAIN FILTER CLAMP

BACKGROUND OF THE INVENTION

1. Field of the Invention

This invention relates generally to mechanisms that secure a fabric to a rigid object and, in particular, to a clamping mechanism that, through a mating process, removably fixes a filter fabric to a foraminous concrete form. Although incorporating the use of adhesives, in but a single instance, such are generally exchewed in the instant invention.

2. Discussion of Relevant Art

Throughout the art, numerous methods and techniques have been used to secure fabrics, of varying mesh, to objects such as frames, screens, etcs. Our patent, U.S. Pat. No. 5,466,092 discloses one such method that involves the use of adhesives. Although quite successful, there unfortunately exists the necessity of fixing form-drain filters during inclement weather, such as periods of rain/sleet. During such times, moisture accumulating on form-drain surfaces, although not constituting a major impediment, nonetheless can inhibit adhesion of the adhesive-coated margins of fabric to the form-drain. Thus, it was incumbent upon us to provide a purely physical means of securing the fabric, irrespective of enviromental conditions.

In a patent entitled: FILTER, U.S. Pat. No. 445,223, there is disclosed an elongated frame member that is defined by a U-shaped cross-section. The legs of the member are considerably longer than the base (of the U) because the member is primarily a frame element that, as an expedient, "caps" the edges of the structural backing. The underlying backing does not serve as a concrete construction form. Most significantly, the long legs, necessary for strength and rigidity, cover a goodly number of the mesh holes (Cf., foramens); a feature we found to be unsatisfactory for our purposes.

U.S. Pat. No. 1,172,724 sets forth a C-shaped (cross-section) clamping member for securing a fabric to a bed frame. This member is a mattress feature known as piping and consists in relatively stiff metallic strips, hence "piping". Although the morphology of the clamp is more desirable for our purposes, the device at issue lacks the mating ability we desire, and achieve, between clamp and form-drain. Further, its ends are curvate, a feature we cannot tolerate with the use of the rigid, straight form-drain.

Similar in style and function to '724 is the clamp shown in U.S. Pat. No. 1,719,532. This clamp is rigid, metallic and essentially curvate, having also a U-form or cross-section. It suffers the same limitations as '724, for our purposes.

A clamping structure consisting of a flexible molding having projecting fasteners is disclosed in U.S. Pat. No. 1,221,444. A molding strip consisting of leather or other flexible materials is multiply cut or diagonally split along its length and nail fasteners are placed therein (perpendicularly) to project at right angles (orthogonally) from the strip. The splits or cuts are then cemented or otherwise resecured to the strip. The purpose of this nail-projecting article is to be self-securable (it is a molding) to another article such a baseboard, furniture, automobile bodies or the like. This could serve as a clamp of sorts, but in '444 no such suggestion is made.

Somewhat analogous to '444, U.S. Pat. No. 2,684,776 relates to a flexable strip of material that contains head-driveable fasteners, such as nails, spaced at predetermined distances by embedment in the strip, which is transparent.

After the fasteners are driven, the strip is pulled free, having performed the dual function of workpiece protection (from misdirected blows) and fastener spacing. A significant distinction between the strip (molding) of '776 and our invention is that this strip cannot conceivably serve as a clamp, it merely resembles our invention in the patent drawings.

Our searches of Patent Office records and various catalogs disclosed no other relevant art. We therefore set forth, in this paper, our clamping concept that serves as an alternative to the aforementioned adhesively secured form-drain filter.

3. Incorporation by Reference

For both provision of background, as well as useful details and prior art information, our U.S. patent no. (to be provided upon issue), and previously discussed U.S. Pat. Nos. 445,223 (FIG. 1); U.S. Pat. No. 1,172,724 (FIGS. 3 and 4); U.S. Pat. No. 1,221,444 (FIGS. 1–6); U.S. Pat. No. 1,719,532 (FIGS. 4–6); and U.S. Pat. No. 2,684,776 (FIGS. 1–3 and columns 1 and 2), are hereby incorporated by reference.

SUMMARY OF THE INVENTION

We have overcome the shortcomings, as well as difficulties presented with use, of the current art by devising inexpensive, readily-made and simple mechanisms to provide a mating with the now well-known, form-drain apparatus. With this mating, acquired by a clamping action, a filter fabric is captured so as to effect a draping of the fabric over the foramens of the foraminous form-drain side. The aforesaid clamping action, which has the purpose of capturing or securing the filter fabric, is acquired through the semi-rigid, yet resilient base of the invention, combined with surface relief devices that are part of integral projections which depend from the base.

A semi-rigid elongated strip of resilient material such as polyvinylchloride (PVC) is extended, in the general embodiment, by parallel, depending projections. In one model, lateral extensions are relatively short, forming a very shallow U-form and include gripping features on inward surfaces of the extensions. This model characteristically "caps" the form-drain article and captures a portion of the filter fabric therebetween.

Another model of our invention mates likewise with the form-drain, but by projection of its dependencies into foramens of the (foraminous) form-drain. In this model, a series of barbed studs project (depend) from the semi-rigid elongated strip of resilient material. The barbs are the gripping feature(s) and the studs are essentially parallel in a fixed, set-apart relationship. In usage, the filter fabric is penetrated by the studs forming a stylized "hemmed" cloak and the "hem" is secured to the form-drain by pressing the studs thereof into the foramens of the top row. Thus, this model clamps the fabric directly to a side of the form-drain.

Other advantages of our invention will become apparent upon further disclosure.

DETAILED DESCRIPTION OF THE PREFERRED EMBODIMENT

Figure 1:
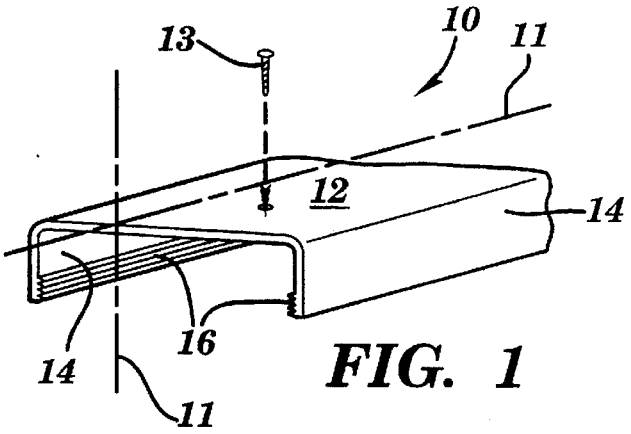
FIG. 1 is an illustration of an end of one model of the invention.

Referring directly to FIG. 1, the embodiment of our invention 10 appears as an elongated, semi-rigid strip 12 (or base) from which depend orthogonal projections 14. The reader's attention is drawn to the short, parallel lateral projections 14 effecting a shape (U) that conforms to a top surface of the form-drain 20 (shown in FIG. 2). The projections must not extend to cover foramens 23 of the form-drain. The final detail of FIG. 1 is the relieved surfaces 16 on the inward facing ends of the projections 14. These surfaces may define any form of gripping relief such as is known in the art, e.g. grooves, knurling, hobnail/detents, etc. Although not specifically detailed here, the surfaces 16 alternately represent an adhesive which, because it presumably contacts a dry fabric, would not violate the conceptual thrust of our invention as presented in the first paragraph of this disclosure. Although not specifically detailed, the invention may be longitudinally truncated at and along lines 11 to present only a portion of the strip 12. Thus, a single lateral dependency 14 is used and fasteners 13, acting as orthogonal projections off one of the strip planes, ensure that the resulting L-shaped strip remains clamped to the form-drain 18.

Figure 2:
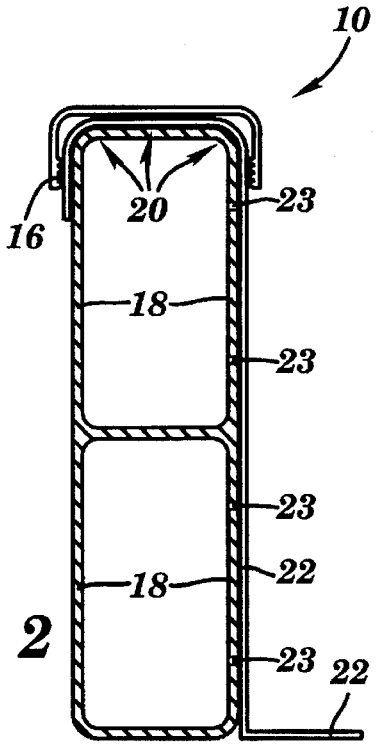
FIG. 2 is a cross-section elevational view of the invention mated to a form-drain physical detail.

The "cap" clamping modality of the invention 10 is represented in FIG. 2 by an end view (elevational) of a form-drain 18, over the top surface of which is draped a bolt of filter fabric 22 which is secured thereto by the invention. The fabric is described in an incorporated reference and is also referred to herein as a "small-particle" filter. Its purpose, in combination with our devices, is to filter soil and sand from the waters entering the form-drain. The gripping or gripping/adhesive features of the invention 10 are clearly visable in this figure and the reader may note that the invention resides as a cap over the top of the form-drain 18, yet does not cover foramens 23 thereof.

Figure 3:
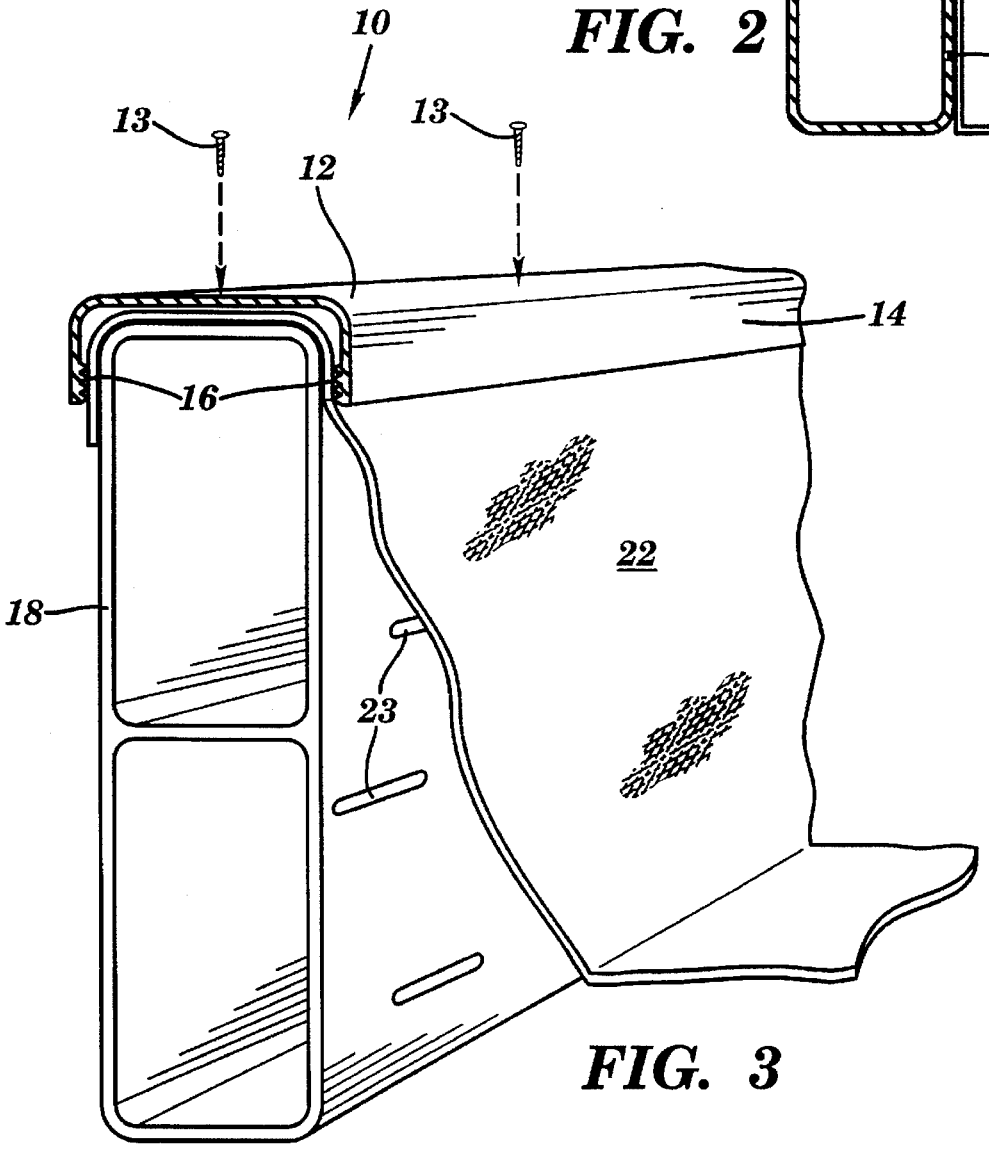
FIG. 3 is a partial perspective illustration of the invention.

FIG. 3 places, in a perspective view, the combination of form-drain 18, filter fabric 22 and clamp device 10 that comprises our contribution to the field.

Figure 4:
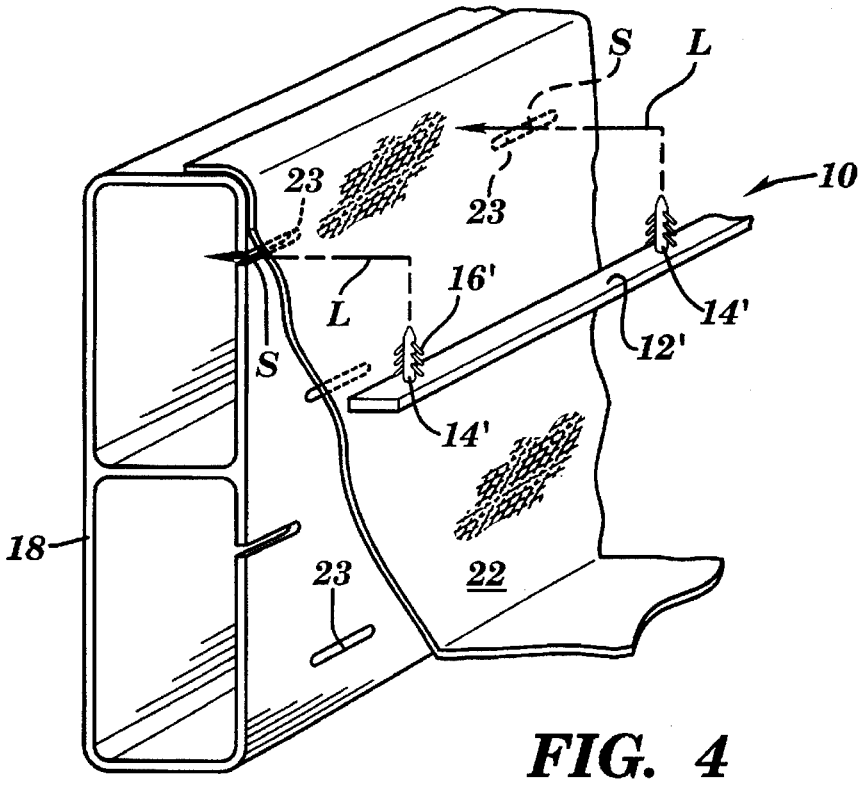
FIG. 4 depicts the invention in another modular/connective form.

The basic concept inculcated herein is applied in an embodiment that clamps to the side of the form-drain. In the illustration of FIG. 4, there is seen a model identified, in its distinction over the first, by prime (') number identifiers. The invention clamp 10 is displayed as an elongated, semi-rigid strip 12' from which project, or depend, at least two stud-like projections 14' that are arrayed in parallel relationship with each other. The projections 14' are configured, in this model, to penetrate the fabric, or at least pass through slits S made therein, and enter formens 23 of the form-drain. Ideally, only a small area of a few foramens will be obstructed by the projections 14', since water may still circumvent the strip 12 and enter the foramens. FIG. 4 clearly illustrates this clamping technique by way of dashed lines L.

Figure 5:
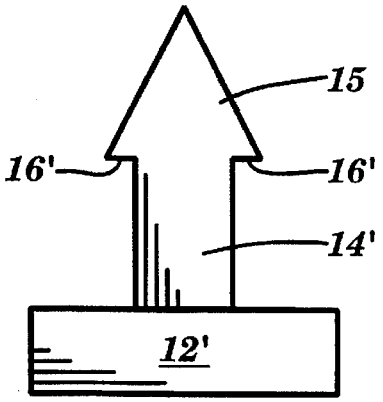
FIG. 5 is an end elevational illustration of the FIG. 4 invention model.

FIG. 5 shows yet another configuration for the barbs 16' of FIG. 4. These features are analogous to relieved surfaces 16 of FIGS. 1,2, and 3. They prevent motion retrograde that of the clamping action, whether "capping" or "inserting" (FIGS. 4, et seq.). In FIG. 5, an end view of strip 12' shows projection 14' bearing a single anti-retraction surface 16' as part of the definition of projection head or apex 15. Those of ordinary skill will readily conclude that anti-retrograde definition may be had by several means, including multiple transverse ridges, flutes, fins, detents, etc. The choice is properly that of the manufacturer.

Figure 6:
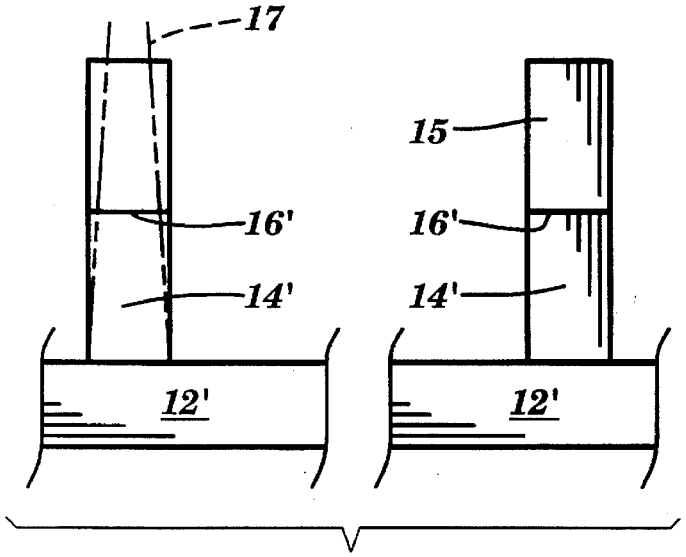
FIG. 6 is a partial side elevation of the invention, FIG. 4 model.

Final to this detailed description, FIG. 6 illustrates, in partial side elevation, a material saving, penetration - enhancing modality of the FIG. 5 device. The projection 14' may be pared down 17, or even conified by an after-forming (e.g. shaper machining) process. Again, this is a detail better left to the manufacturer's judgment.

Figure 7:
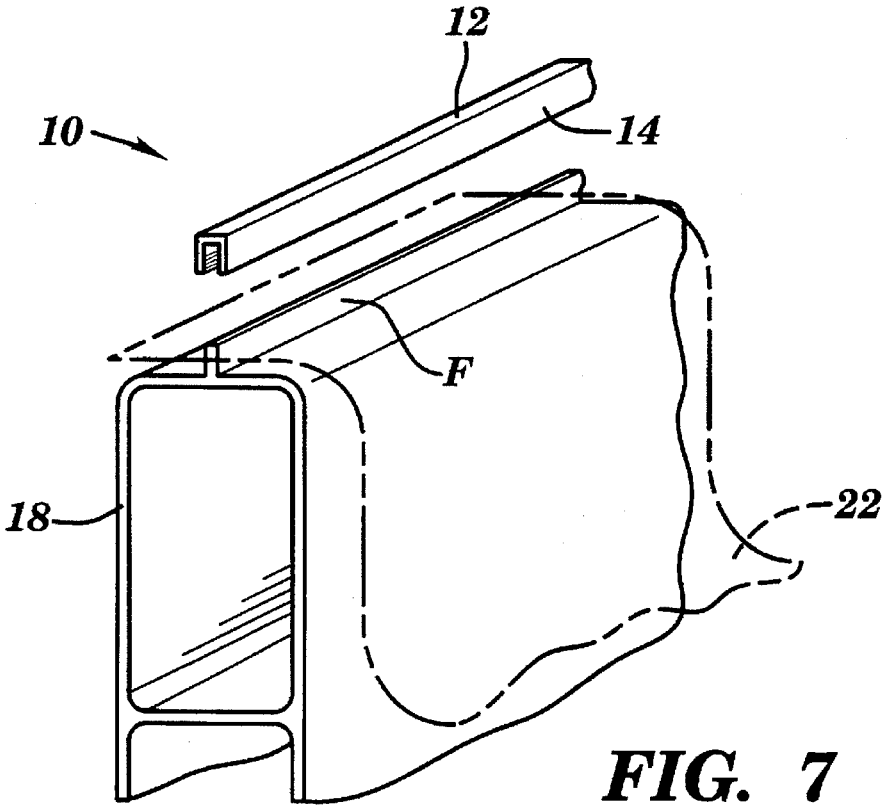
FIG. 7 is an illustration of a smaller model of the invention as it would mate with, or clamp to, an improved detail of the form-drain.
Figure 8:
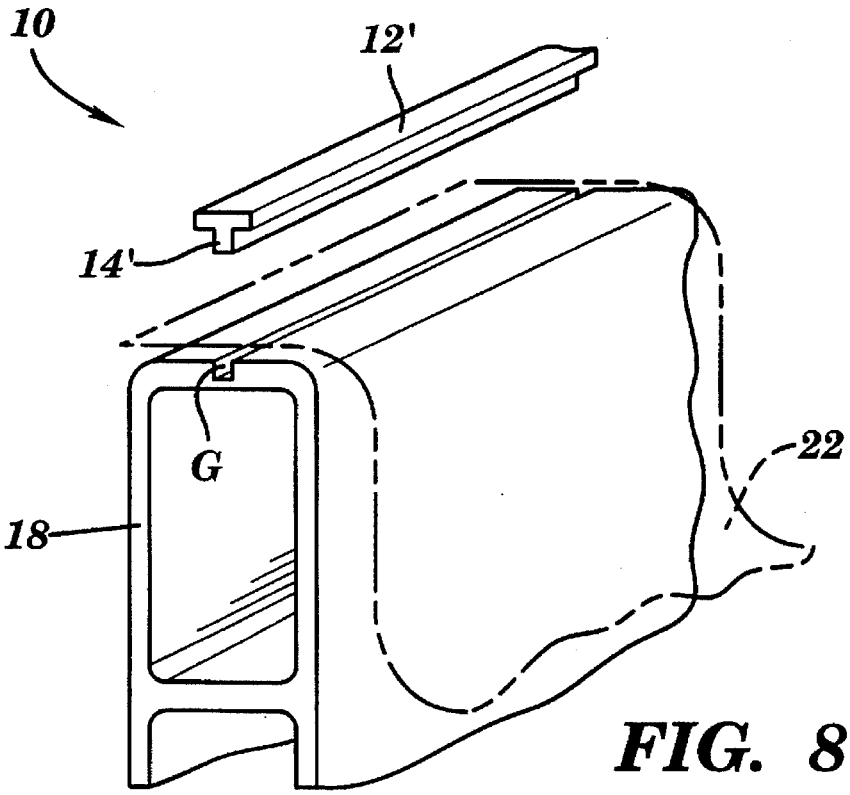
FIG. 8 is an illustration of the invention with a singular depending structure for clamping/mating to a grooved form-drain.

Should a modification be made to the top surface of the form-drain, such as depicted in FIG. 7, the invention is still usable in its capping modality (FIGS. 1–3). Here it caps longitudinal flange F of the form-drain 18. The filter 22 is not depicted, but is readily captured between the features 12/14 of the invention and the form-drain flange F. Another modification of the form-drain, a top longitudinal groove G, allows usage of the invention's second model 12'/14' essentially as shown in FIGS. 5 and 6 with physical continuity from and between studs 14', but absent barb 16'. Yet either of these models may be used to act as a spline in order to capture the fabric 22 between the form-drain detail G and the dependency 14'. To lessen the complication and expense of carrying multiple inventories, form-drain and/or invention manufacturers may elect to make or use the models of FIGS. 4–6 as shown, or in lieu of the strip of FIG. 8.

By the appended claims we assert our right to exclusive exploitation of the instant invention and its combination with other artforms. Its use is commended to the field consistent with these claims.

What is claimed is:

1. A form-drain filter combination comprising:

a foraminous concrete footing form-drain which features a hollow concrete form member having multiple in-line foramens through one side thereof that communicate with the interior thereof;

a small-particle filter fabric draped on said one side to cover the foramens; and a clamping means, permanently installable, fittable and shapewise conformable to a flat feature of the form-drain, for removably capturing a margin of the fabric between the clamping means and said feature of the form-drain.

2. The combination of claim 1, wherein said clamping means is an elongated, essentially flat, semi-rigid member which has projecting out of a plane thereof at least two elements for clamping said margin to said form-drain.

3. The combination of claim 2 wherein said at least two elements are parallel orthogonal projections depending from said flat member and which include means for retarding a declamping movement.

4. The combination of claim 3 wherein said projections comprise at least one lateral extension of said semi-rigid member.

5. The combination of claim 4 wherein said at least one lateral extension has a motion retarding, relieved end for clamping said margin to said detail which is an upper portion of the form-drain.

6. The combination of claim 3 wherein said at least two elements are multiple projecting studs which effect penetration of the fabric and pass into the said detail which comprises formamens, said studs retarded from removal by a non-retrograde mechanism thereon.

7. A form-drain and filter clamp assembly comprising:

a foraminous, hollow, form-drain having an elongated plank definition for forming concerte footings, each elongated element of said form-drain possessing only one foraminous side that features a plurality of in-line apertures; and a permanently installed, full contact, straight flat clamping means for securing a margin of a small-particle filter fabric at a flat form-drain element so that the fabric, when draped thereover, covers all said apertures and said clamping means fully contacts said margin to pressingly urge it against said element.

8. The assembly of claim 7 wherein said clamping means is an elongated member having projecting gripping means thereon.

9. The assembly of claim 8 wherein said projecting gripping means is a series of discrete studs each having a non-retrograde motion means, said studs insertable into foramens of said form-drain.

10. The assembly of claim 8 wherein said projecting gripping means further comprises at least one extension of said member by a side that projects orthogonally therefrom and is terminated in a gripping means.

11. The assembly of claim 10 wherein said gripping means further comprises inwardly facing, relieved surfaces.

12. The assembly of claim 7 wherein said clamping means is a spline member for insertion into a grooved detail of said form-drain effective for capture of a fabric therebetween.

13. A filter clamp for securing a fabric to a rigid, hollow and foraminous form-drain, said form-drain used to form a concrete footing and subsequently serve as a drain means therefor, said clamp comprising an elongated, semi-rigid member having a preponderantly flat character and including a gripping means that is shaped to effect a capture of the fabric between the form-drain and the clamp when the latter is mated to the former and, further, the clamp effective for making full contact between the fabric and said flat character.

14. The clamp of claim 13 wherein said gripping means comprises at least one projection from the semi-rigid member, said projection terminating in a relieved surface.

15. The clamp of claim 14 wherein said relieved surface comprises grooves and ridges.

16. The clamp of claim 14 wherein said relieved surface comprises a plurality of detents.

17. The clamp of claim 13 wherein said gripping means comprises at least one depending side of the semi-rigid member, said side including an inwardly facing, adhesive-coated surface.

18. The clamp of claim 13 wherein said gripping means comprises a series of barbed, projecting studs effective for penetrating the fabric and anchoring in foramens of the form-drain.

19. The clamp of claim 13 wherein said gripping means comprises an orthogonally depending flange effective for insertion into a grooved detail of the form-drain.

* * * * *